US006270057B1

(12) United States Patent
Highley et al.

(10) Patent No.: US 6,270,057 B1
(45) Date of Patent: Aug. 7, 2001

(54) REUSEABLE MULTI-STORY BUILDING CONSTRUCTION GUARDRAIL SYSTEM

(75) Inventors: Frank M. Highley, Raleigh; Gregory S. Heffner, Wendell; Patrick V. Vines, Pittsboro; Eric H. Rasmussen, Raleigh; David C. Thompson, Pittsboro; M. Lyle Gurley, Jr., Raleigh, all of NC (US)

(73) Assignee: Centurion Construction Company, Raleigh, NC (US)

( * ) Notice: Subject to any disclaimer, the term of this patent is extended or adjusted under 35 U.S.C. 154(b) by 0 days.

(21) Appl. No.: 09/212,845

(22) Filed: Dec. 16, 1998

(51) Int. Cl.[7] ..... E04G 3/12
(52) U.S. Cl. ..... 256/32; 256/DIG. 6; 256/65
(58) Field of Search ..... 256/DIG. 6, 32, 256/10, 59, 65; 248/237; 182/113, 45

(56) References Cited

U.S. PATENT DOCUMENTS 2,960,335 * 11/1960 Shttleworth ..... 182/113 X
3,901,481 * 8/1975 Probst ..... 348/237 X
3,995,833 * 12/1976 McLaughlin et al. ..... 256/65 X
4,003,553 * 1/1977 Morris ..... 256/59
4,666,131 * 5/1987 Kettelkamp, Sr. et al. .... 256/DIG. 6 X
4,787,475 * 11/1988 Arteau et al. ..... 256/65 X
4,920,331 * 4/1990 Ver Loren van Thema ..... 256/12 X
4,989,689 * 2/1991 Berlin ..... 248/237 X
5,188,342 * 2/1993 Ouellette et al. ..... 256/59 X
5,263,550 * 11/1993 Jines et al. ..... 256/DIG. 6 X
5,353,891 * 10/1994 Griek et al. ..... 256/59 X
5,409,195 * 4/1995 Strickland et al. ..... 256/DIG. 6 X
5,573,227 * 11/1996 Hemauer et al. ..... 256/59 X
5,586,423 * 12/1996 Mullen ..... 256/DIG. 6 X
5,896,944 * 4/1999 McMillian et al. ..... 182/45
6,038,829 * 3/2000 Franks ..... 248/237 X
6,053,281 * 4/2000 Murray ..... 256/DIG. 6 X

* cited by examiner

*Primary Examiner*—Lynne H. Browne
*Assistant Examiner*—John R. Cottingham
(74) *Attorney, Agent, or Firm*—Jenkins & Wilson, P.A.

(57) ABSTRACT

A guardrail system for enhanced fall protection during the construction of a multi-story building subsequent to steel erection. The guardrail system includes an elongated bar comprising a first relatively short portion and a second relatively long portion that define an obtuse angle therebetween, and one or more apertures in both the first portion and the second portion of the bar. A plate is provided to be bolted to the first portion of the elongated bar in order to removably attach the bar to a perimeter frame element of a multi-story building frame with the second portion extending upwardly and inwardly into the building. Cable is then pulled through one or more apertures of the second portions of a selected plurality of elongated bars secured to a perimeter frame element to complete the guardrail system.

2 Claims, 3 Drawing Sheets

REUSEABLE MULTI-STORY BUILDING CONSTRUCTION GUARDRAIL SYSTEM

TECHNICAL FIELD

The present invention relates to guardrail systems, and more particularly to a reusable guardrail system to provide perimeter support during construction of a multi-story building and does not interfere with subsequent elevated slab concrete pouring or the construction of building wall systems.

BACKGROUND ART

Applicants are aware of many efforts to provide a satisfactory handrail system in order to provide fall protection during the construction of multi-story buildings. For example, it is known to utilize wood structures, steel tubes welded to the building frame, and orange mesh-type fencing in order to provide fall protection to construction workers during construction of a multi-story building. More recently, OSHA has set forth certain minimum requirements for guardrail systems that include (among other requirements) that the guardrail withstand a load of 200 pounds applied within 2.0 inches of the top.

As is well known to those familiar with the construction of multi-story buildings, the aforementioned prior art guardrail systems all suffer shortcomings in performance and typically require patching of the concrete slab in proximity thereto when the prior art guardrail systems are removed. Moreover, prior art handrail systems are typically not reusable and many times do not meet the aforementioned OSHA guidelines for handrail systems.

Thus, there is a long-felt need for an improved and reusable guardrail system for use in the construction of multi-story buildings that meets OSHA requirements and is relatively inexpensive and simple to use.

DISCLOSURE OF THE INVENTION

In accordance with the present invention, applicants provide a guardrail system for fall protection during the construction of a multi-story building. The guardrail system comprises an elongated bar element with a flange on one end thereof. The bar element is formed with a first relatively short linear portion that extends perpendicularly from the flange and a second relatively long linear portion that is connected to and extends from the first portion so as to define an obtuse angle therebetween. One or more apertures are provided through the first linear portion of the bar element, and one more apertures are also provided through the second linear portion of the bar element. A securement plate is provided that has one or more apertures therethrough so that the securement plate can be bolted to the first linear portion of the elongate bar element in order to removably attach the bar element to a selected perimeter frame element of a multi-story building under construction. Thereafter, one or more cables are pulled through the one or more apertures in the second linear portion of a plurality of spaced-apart bar elements in order to form a protective guardrail system. Most suitably, the elongated bar elements are each attached to a frame element of the multi-story building with their respective second linear portion extending upwardly and inwardly from the exterior of the building so as to allow for construction of wall systems while the guardrail system is in place.

It is therefore an object of the present invention to provide an improved guardrail system for use during construction of a multi-story building;

It is another object of the present invention to provide a reusable guardrail system for use in the construction of a multi-story building;

It is another object of the present invention to provide an inexpensive and simple-to-use guardrail system for use in the construction of a multi-story building that does not interfere with elevated slab concrete pours or the installation of wall systems; and It is still another object of the present invention to provide a guardrail system that can be removed after use without requiring any patching or repair to elevated concrete slabs and that meets all relevant OSHA requirements.

Some of the objects of the invention having been stated hereinabove, other objects will become evident as the description proceeds, when taken in connection with the accompanying drawings as best described hereinbelow.

BEST MODE FOR CARRYING OUT THE INVENTION

Figure 1:
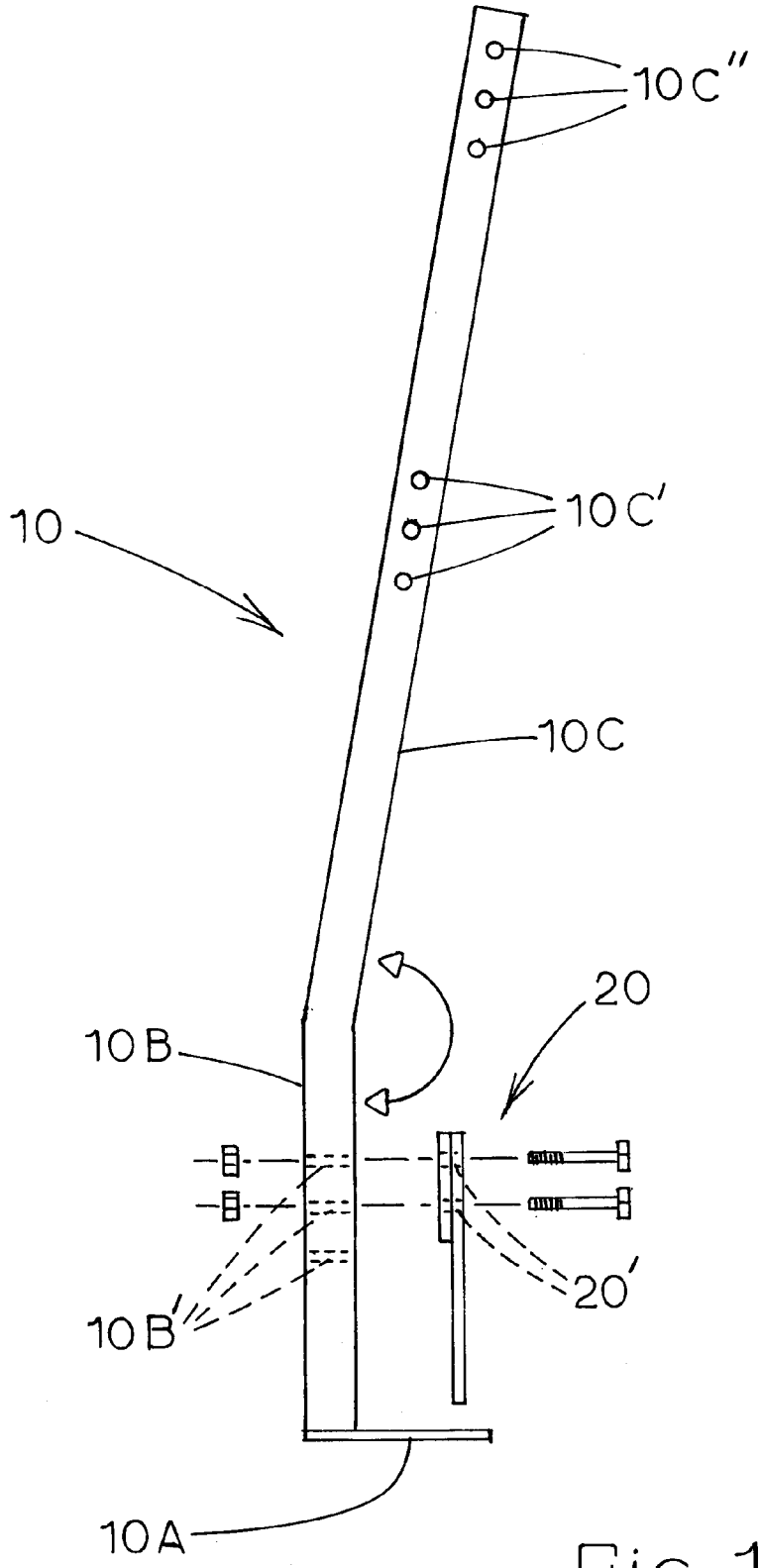
FIG. 1 is a side elevation view of the guardrail system of the present invention.

Referring now to FIGS. 14 of the drawings, applicants' novel guardrail system will be described in detail. The guardrail system comprises bar element 10 that includes a flange 10A on the lower end thereof. Flange 10A is welded or otherwise affixed to first relatively short linear portion 10B extending perpendicularly from flange 10A, and a second linear portion 10C is connected to and extends from first linear portion 10B so as to define an obtuse angle therebetween as shown by the arrow at the intersection of first linear portion 10B and second linear portion 10C. First linear portion 10B of bar element 10 includes three apertures 10B' extending therethrough from front to back. Second linear portion 10C of bar element 10 includes a first set of three transverse spaced-apart apertures 10C' in the medial portion thereof and a second set of three transverse spaced-apart apertures 10C' adjacent the top free end of second linear portion 10C. Also, as shown in the drawings, applicants' novel guardrail system includes a securement plate, generally designated 20, that includes two spaced-apart apertures 20' therethrough to facilitate bolting securement plate 20 to first linear portion 10B of bar element 10 in such a way as to removably attach bar element 10 to a selected perimeter frame element (or the like) of a multi-story building subsequent to steel erection and during construction of the multi-story building (not shown).

Applicants' inventive guardrail system is intended to replace conventional structures welded to the multi-story building frame and conventional mesh-type fencing used in order to prevent construction workers from falling and becoming injured during construction of a multi-story building following steel erection. The guardrail system is intended for use as an intermediate support between vertical column frame members and would most typically be formed of steel and have wire rope or cable strung between a plurality of spaced-apart bar elements 10 to form a fence to prevent construction workers from falling and becoming injured.

Figure 2:
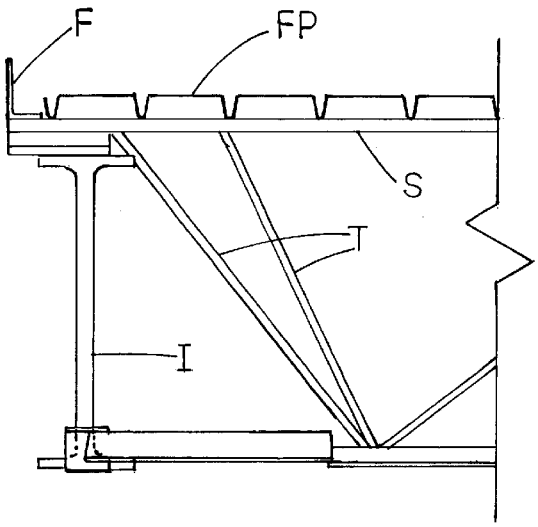
FIG. 2 is a vertical cross-sectional view of the perimeter of a multi-story building under construction prior to installation of the guardrail system of the present invention.
Figure 3:
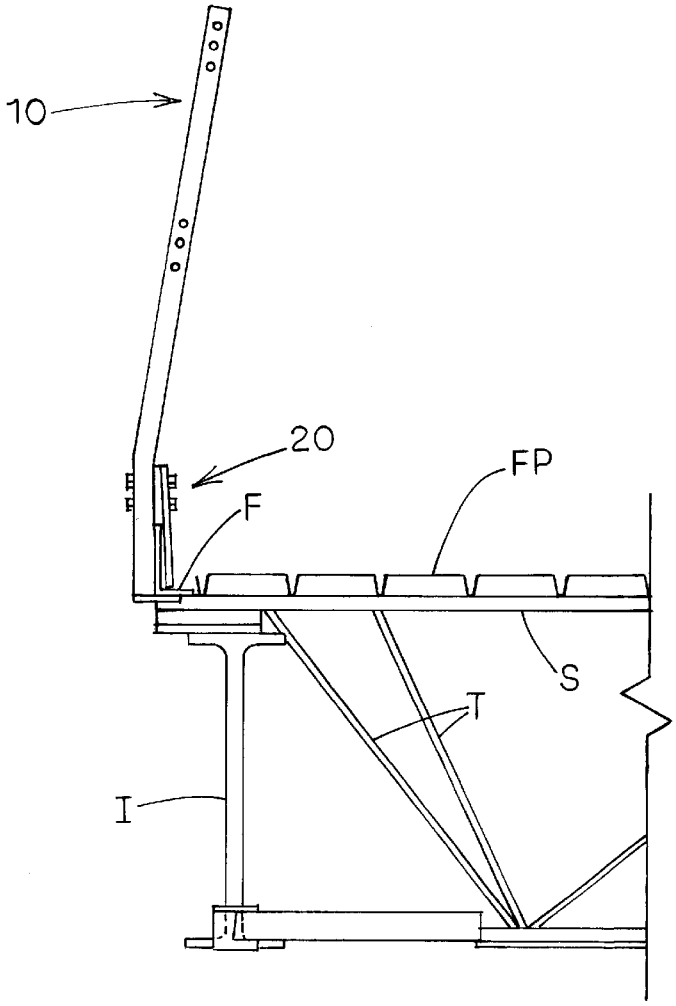
FIG. 3 is a vertical cross-sectional view of the perimeter construction of a multi-story building subsequent to installation of the guardrail system of the present invention.
Figure 4:
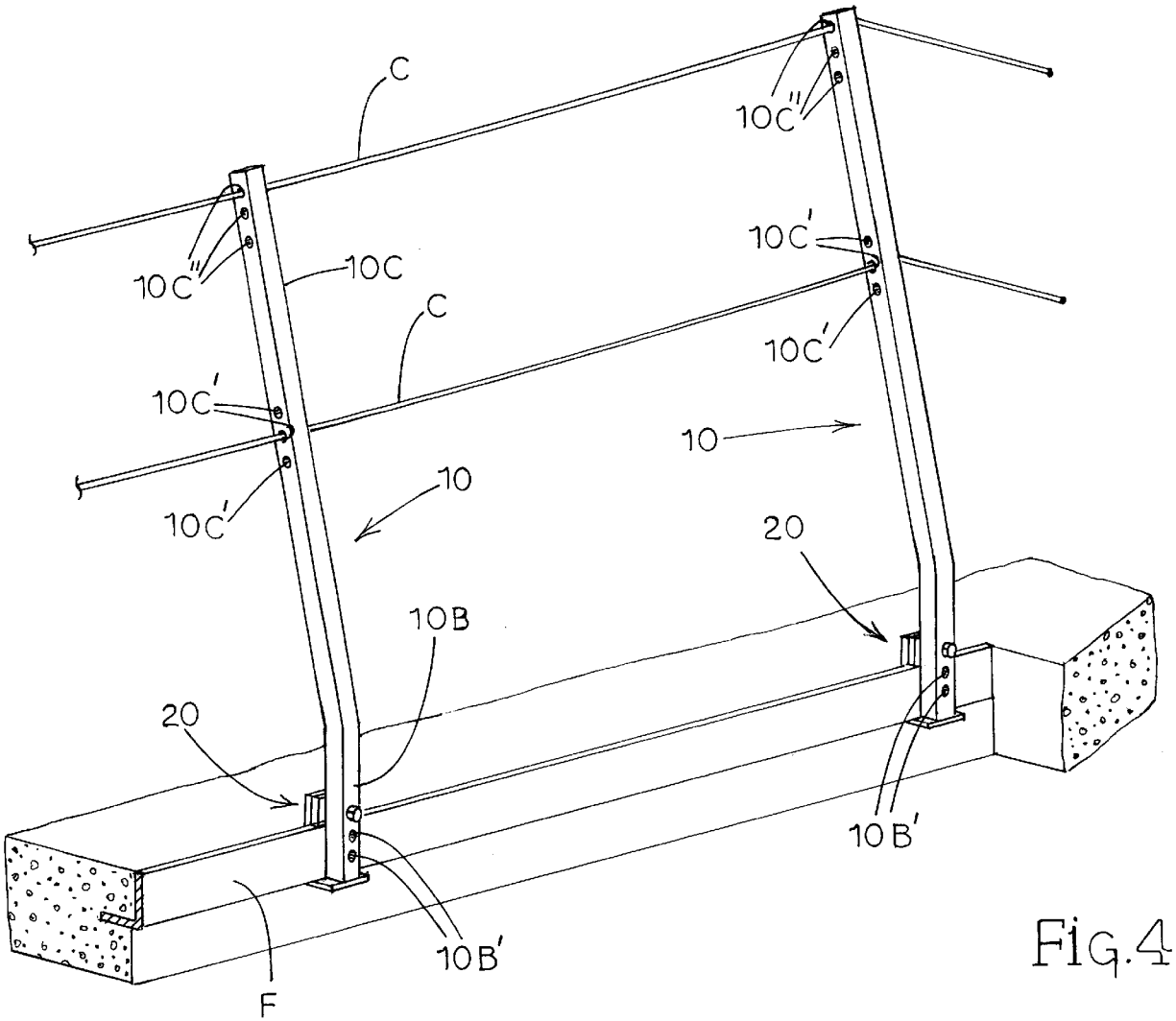
FIG. 4 is a perspective view of a guardrail system in accordance with the present invention installed at a construction site.

As best seen in FIGS. 2–4 elongated bar elements 10 are bolted to the outside of frame member F that forms the outer perimeter of a conventional elevated slab floor support structure consisting of I-beam floor joists I and trusses T that serve to support horizontal floor supports S and corrugated floorpan FP thereabove into which concrete will be poured in order to form an elevated concrete slab floor surface in a multi-story building. Thus, a plurality of elongated bar elements 10 are secured to perimeter frame element F by bolting a corresponding plurality of securement plates 20 to the back surface of perimeter frame element F and thereby removably affixing corresponding elongated bar elements 10 to the front surface of perimeter frame element F. Once a plurality of bar elements are secured in spaced-apart relationship around a selected length of perimeter frame element F, one or more suitable wire ropes or cables C will be pulled through one or more selected apertures 10C' and/or 10C" as a matter of user choice in order to provide a sturdy guardrail system around elevated perimeters of a multi-story building to prevent injuries to construction workers who might otherwise fall from an elevated portion of the erected steel frame of the multi-story building. The upper portion or second linear portion of bar elements 10 extend upwardly and inwardly into the building so as to allow a wall system to be built adjacent the perimeter frame with bar elements 10 in place.

Applicants' inventive guardrail system consisting of elongated bar elements 10 and corresponding securement plates 20 is simple and inexpensive since it can be easily removed and reused without requiring any patching to a subsequently poured concrete floor surface. Moreover, the inventive guardrail system is believed to meet relevant OSHA guidelines and criteria for fall protection systems used in the construction of multi-story buildings.

Although applicants' guardrail system can be formed in a wide variety of different sizes and from different materials, applicants contemplate that bar elements 10 and securement plates 20 will most suitably be formed of steel. Also, first linear portion 10B of bar element 10 most suitably is about 13.0 inches in length and second linear portion 10C is about 37.0 inches in length. The angle formed between first and second linear portions 10B and 10C, respectively, as shown by the arrow in FIG. 1 is most suitably about 171.5 degrees. Furthermore, applicants contemplate providing three spaced-apart apertures 10B' that extend front to back in linear portion 10B, three spaced-apart apertures 10C' that extend from side to side in the medial portion of elongate bar element 10, and three spaced-apart apertures 10C" that extend from side to side in the upper portion of adjacent the free end thereof of elongate bar element 10. Although other cable could be utilized in the guardrail system of the invention, applicants contemplate that cable strands C will most suitably be stranded wire cable.

Therefore, applicants contemplate that the inventive guardrail system of the present invention that has been designed to provide fall protection during multi-story building construction has the following advantages over prior art handrail systems:

1. All parts are reusable (e.g., elongated bar elements 10, securement plates 20 and cables C);
2. The guardrail system can be installed immediately after steel erection in a multi-story building under construction in order to provide protection during all remaining phases of construction of the multi-story building;
3. The guardrail system provides protection during elevated slab concrete pouring without interfering with the pouring;
4. The guardrail system is designed to be easily installed without welding or powder actuated fasteners;
5. The guardrail system can be removed after installation of building wall systems without damage to the wall systems;
6. The guardrail system allows for construction of the wall system while the guardrail system is in place and thereby provides protection during multi-story building construction without interfering with ongoing construction;
7. The guardrail system can be removed without requiring patching or repairing to concrete slabs; and
8. The guardrail system is designed to meet OSHA requirements and criteria when utilized on concrete slabs ranging from 2.50 to 6.0 inches in depth.

It will be understood that various details of the invention may be changed without departing from the scope of the invention. Furthermore, the foregoing description is for the purpose of illustration only, and not for the purpose of limitation—the invention being defined by the claims.

What is claimed is:

1. A guardrail system for fall protection during the construction of a multi-story building comprising:

(a) an elongated bar element having a flange on one end thereof and a first relatively short linear portion extending perpendicularly from said flange and a second relatively long linear portion connected to and extending from said first portion so as to define an obtuse angle therebetween, and wherein said bar element includes three spaced-apart apertures in the medial portion of said first linear portion, three spaced-apart apertures in the medial portion of said second linear portion and three spaced-apart apertures adjacent the free end of said second linear portion opposite said first linear portion; and (b) a securement plate having one or more apertures therethrough for bolting said plate to said first linear portion of said bar element so as to removably attach said bar element to a frame element of a multi-story building during construction thereof.

2. In combination, (a) a multi-story building frame and (b) a guardrail system for fall protection during the construction of a multi-story building after erection of the building frame, said guardrail system comprising:

(a) an elongated bar element having a flange on one end thereof and a first relatively short linear portion extending perpendicularly from said flange and a second relatively long linear portion connected to and extending from said first portion so as to define an obtuse angle therebetween, and wherein said bar element includes 3 spaced-apart apertures in the medial portion of said first linear portion, 3 spaced-apart apertures in the medial portion of said second linear portion and 3 spaced-apart apertures adjacent the free end of said second linear portion opposite said first linear portion; and (b) a securement plate having one or more apertures therethrough for bolting said plate to said first linear portion of said bar element so as to removably attach said bar element to said perimeter frame element of a multi-story building during construction thereof.

* * * * *